United States Patent [19]

Cook et al.

[11] Patent Number: 4,834,895

[45] Date of Patent: May 30, 1989

[54] ARTICLES AND METHODS FOR TREATING FABRICS IN CLOTHES DRYER

[75] Inventors: Thomas E. Cook; Rodolfo Delgado, both of Cincinnati; Carlos G. Linares, Fairfield; Nabil Y. Sakkab, Cincinnati; Toan Trinh, Maineville, all of Ohio

[73] Assignee: The Procter & Gamble Company, Cincinnati, Ohio

[21] Appl. No.: 86,116

[22] Filed: Aug. 17, 1987

[51] Int. Cl.[4] ..... C11D 1/66; D06F 58/00

[52] U.S. Cl. ..... 252/8.6; 252/8.8; 252/91; 252/174.19; 252/8.9; 428/290; 427/242; 106/14.05; 106/14.35; 422/8; 422/9

[58] Field of Search ..... 252/8.6, 8.8, 8.9, 91; 428/290; 427/242; 106/14.05, 14.35; 422/8, 9

[56] References Cited

U.S. PATENT DOCUMENTS

| | | | |
|---|---|---|---|
| 2,512,949 | 6/1950 | Lieber | 428/429.6 |
| 2,564,423 | 8/1951 | Barnum | 106/14.27 |
| 3,632,396 | 1/1974 | Perez-Zamora | 117/76 P |
| 3,650,816 | 3/1972 | Rudy et al. | 117/109 |
| 3,676,199 | 7/1972 | Hewitt et al. | 117/109 |
| 3,696,034 | 10/1972 | Hewitt et al. | 252/8.8 |
| 3,928,212 | 12/1975 | Gofo et al. | 252/8.6 |
| 3,936,538 | 2/1976 | Marshall et al. | 427/242 |
| 4,000,340 | 12/1976 | Murphy et al. | 428/35 |
| 4,012,326 | 3/1977 | Rudy et al. | 252/8.8 |
| 4,025,444 | 5/1977 | Murphy et al. | 252/8.8 |
| 4,035,307 | 7/1977 | Fry et al. | 252/8.6 |
| 4,057,673 | 11/1977 | Falivene | 428/411 |
| 4,095,946 | 6/1978 | Jones et al. | 8/137 |
| 4,103,047 | 7/1978 | Zaki et al. | 427/242 |
| 4,113,630 | 9/1978 | Hagner et al. | 252/8.6 |
| 4,118,525 | 10/1978 | Jones | 427/242 |
| 4,137,345 | 1/1979 | Falivene | 427/242 |
| 4,139,477 | 2/1979 | Hayek et al. | 252/8.8 |
| 4,514,444 | 4/1985 | Ives et al. | 427/242 |
| 4,569,772 | 2/1986 | Ciallella | 252/8.6 |

FOREIGN PATENT DOCUMENTS

| | | |
|---|---|---|
| 1121111 | 8/1978 | Canada . |
| 33134 | 8/1981 | European Pat. Off. . |
| 048163 | 3/1982 | European Pat. Off. . |
| 130682 | 1/1985 | European Pat. Off. . |
| 0194127 | 9/1986 | European Pat. Off. . |
| 57-191372 | 5/1981 | Japan . |

*Primary Examiner*—Paul Lieberman
*Assistant Examiner*—Ronald A. Krasnow
*Attorney, Agent, or Firm*—Robert B. Aylor; Richard C. Witte

[57] ABSTRACT

Dryer-added fabric conditioning articles and methods utilizing fabric softener agent, polymeric soil release agent, and protecting agent to protect dryer surfaces.

14 Claims, No Drawings

ARTICLES AND METHODS FOR TREATING FABRICS IN CLOTHES DRYER

TECHNICAL FIELD

The present invention encompasses articles and methods for providing soil release, softening, odor, and antistatic benefits to fabrics in an automatic clothes dryer.

BACKGROUND OF THE INVENTION

Treatment in an automatic clothes dryer has been shown to be an effective means for imparting desirable tactile properties to fabrics. For example, it is becoming common to soften fabrics in an automatic clothes dryer rather than during the rinse cycle of a laundering operation. (See U.S. Pat. No. 3,442,692, Gaiser, issued May 6, 1969, incorporated herein by reference.)

Fabric "softness" is an expression well-defined in the art and is usually understood to be that quality of the treated fabric whereby its handle or texture is smooth, pliable and fluffy to the touch. Various chemical compounds have long been known to possess the ability to soften fabrics when applied to them during a laundering operation.

Fabric softness also connotes the absence of static "cling" in the fabrics, and the commonly used cationic fabric softeners provide both softening and antistatic benefits when applied to fabrics. Indeed, with fabrics such as nylon and polyester, the user is more able to perceive and appreciate an antistatic benefit than a true softening benefit.

Soil release treatment of fabrics in an automatic clothes dryer is not as common as softening treatment.

U.S. Pat. No. 4,238,531, Rudy et al., issued Dec. 9, 1980, discloses in its Examples 8 and 9 a soil release agent adjuvant plus a "distributing aid," polyethylene glycol (PEG). The key combination of fabric softening plus soil release treatment in one automatic clothes dryer product is not disclosed.

U.S. Pat. application Ser. No. 022,615, Evans et al., filed Mar. 3, 1987, discloses dryer-added articles comprising fabric softening and soil release agents.

SUMMARY OF THE INVENTION

The present invention encompasses an article of manufacture adapted for use to provide fabric soil release benefits and to soften fabrics in an automatic laundry dryer comprising:

(a) fabric conditioning agent, selected from the group consisting of polymeric soil release agent, fabric softening agent, and mixtures thereof, that tends to damage one or more dryer surfaces;

(b) a protecting agent to provide protection for the surface of said automatic laundry dryer having the formula RZR, wherein each R is a hydrocarbon group, preferably alkyl and each 2 is selected from the group consisting of a single covalent bond, an ester group, an amide group, a ketone group, an ether group, and $$-\overset{O}{\overset{\|}{C}}-O(C_2H_4O)_nC-$$

wherein each n is 1 or 2, and wherein said protecting agent can be mobilized under said dryer's conditions, but will crystallize before said fabric conditioning agents; and (c) a dispensing means which provides for release of an effective amount of said fabric conditioning agent to fabrics in the dryer at automatic dryer operating temperatures, i.e., 35° C. to 115° 1 C.

The invention also encompasses a method for imparting soil releasing benefits plus a softening and antistatic effect to fabrics in an automatic clothes dryer comprising tumbling said fabrics under heat in a clothes dryer with an effective, i.e., softening, amount of a composition comprising softening active(s), soil release agent, and said protecting agent. The soil release benefits for fabrics are provided for a wide range of soils including the oily types and clay soils on polyester and polyester/cotton blend fabrics.

DESCRIPTION OF THE PREFERRED EMBODIMENT

The present invention encompasses an article of manufacture adapted for use to provide fabric soil release benefits and/or to soften fabrics in an automatic laundry dryer comprising:

(a) one or more fabric conditioning agents which are in solid form with melting points above about 38° C. and being flowable at dryer operating temperatures, said components comprising:

i. polymeric soil release agent, e.g., at a level of from about 1% to about 70%;

ii. fabric softening agent, e.g., at a level of from about 30% to about 97%; or iii. mixtures of i. and ii.

(b) from about 3% to about 40%, preferably from about 5% to about 15%, of protecting agent for the surface of said automatic laundry dryer selected from the group consisting of: long chain fatty acid esters of ethylene glycol or diethylene glycol, long chain alkanes, microcrystalline waxes, di (long chain alkyl) ethers, long alkyl and/or acyl chain esters or amides or ketones, and mixtures thereof, that have melting points between about 50° C. and about 95° C., preferably between about 60° C. and about 85° C., said protecting agent being in a form that permits it to separate from the other ingredients under dryer conditions and crystallize on the surfaces of said dryer; and (c) a dispensing means which provides for release of an effective amount of said fabric conditioning agent, or agents, to fabrics in the dryer at automatic dryer operating temperatures, i.e., 35° C. to 115° C.

When the dispensing means is a flexible substrate in sheet configuration the fabric conditioning composition is releasably affixed on the substrate to provide a weight ratio of fabric conditioning component to dry substrate ranging from about 10:1 to about 0.5:1.

The invention also encompasses a method for imparting soil releasing benefits plus a softening and antistatic effect to fabrics in an automatic clothes dryer while allowing the use of a wide variety of finishes on the clothes dryer.

The term "fabric conditioning agent" as used herein refers to polymeric soil release agents, fabic softening agents and mixtures thereof, as defined herein.

Polymeric Soil Release Agent

The polymeric soil release agents useful in the present invention include hydroxyether cellulosic polymers, block copolymers of polyethylene terephthalate and polyoxyethylene terephthalate, block copolymers of polyethylene phthalate and polyethylene glycol, and cationic guar gums, and the like. The soil release agent is present at a level of from about 1% to about 70%, more preferably from about 10%, and most preferably from about 25% to about 50%, by weight of the fabric conditioning composition. The invention is primarily of interest for nonionic soil release agents and especially those with terminal polyethylene oxide groups since those are more prone to soften dryer finishes.

The cellulosic derivatives that are functional as soil release agents can be charaterized as certain hydroxyethers of cellulose such as Methocel HB-15000 (Dow), Methyl Cellulose DM-140 (Buckeye), and Klucel (Hercules); also, certain cationic cellulose ether derivatives such as Polymer JR-125, JR-400, and JR-30M (Union Carbide).

Other effective soil release agents are cationic guar gums such as Jaguar Plus (Stein Hall) and Gendrive 458 (General Mills).

A preferred polymeric soil release agent is selected from the group consisting of methyl cellulose, hydroxypropyl methylcellulose, or hydroxybutyl methylcellulose, said cellulosic polymer having a viscosity in 2% aqueous solution at 20° C. of 15 to 75,000 centipoise.

More preferred nonionic soil release agents are copolymers having blocks of polyethylene terephalate and polyoxyethylene terephthalate. More specifically, these polymers are comprised of repeating units of ethylene terephthalate and polyoxyethylene terephthalate at a molar ratio of ethylene terephthalate units to polyoxyethylene terephthalate units of from about 25:75 to about 35:65, said polyoxyethylene terephthalate containing polyoxyethylene blocks having molecular weights of from about 300 to about 700. The molecular weight of this polymeric soil release agent is in the range of from about 25,000 to about 55,000. These preferred polymers are disclosed in U.S. Pat. No. 3,959,230, Hays, issued May 25, 1976, incorporated herein by reference. The melting point of the polymer is preferably below 100° C.

Another preferred nonionic polymeric soil release agent is a crystallizable polyester copolymer with repeat units of ethylene terephthalate units containing 10–50% by weight of ethylene terephthalate units together with 90–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. A more preferred polymer is that wherein the polyoxyethylene terephthalate units are derived from a polyoxyethylene glycol with an average molecular weight of from about 1,000 to about 4,000. These polymers are disclosed in U.S. Pat. No. 3,416,952, McIntyre and Robertson, issued Dec. 17, 1968, incorporated herein by reference. Examples of these copolymers include the commercially available material Zelcon$^R$ 4780 (from DuPont) and Milease$^R$ T (from ICI Americas Inc.), both have the Chemical Abstracts Service Registry No. 9016-88-0. Both Zelcon 4780 and Milease T are sold in the aqueous dispersion form containing up to 85% water. It is preferable to use the dehydrated polymer to prepare the fabric conditioning composition in order to avoid the incorporation of excess moisture which is beleived to make the resulting fabric conditioning articles wet and sticky. The dehydrated polymer is obtained by drying the above-mentioned commercial dispersions, or can be obtained directly in the concentrated form from the manufacturers. An example of the latter is Zelcon PGA, and is obtained from DuPont Co.

The most preferred polymer is a solid at room temperature, has a softening phase transition temperature at or above 30° C. and becomes a flowable liquid below 100° C., preferably below 90° C. The softening phase transition temperature can be determined by the differential scanning calorimetry (DSC) method. A polymer that is a hard solid at room temperature is desirable in order to keep the fabric conditioning sheets from having a tacky feel, while its softening and fluidity at higher temperatures facilitate the substrate coating process and the subsequent fabric conditioning active transfer from the fabric conditioning sheet to the fabrics in the clothes dryer. An example of this polymer is Milease TL which is derived from a polyethylene glycol of about 1500 average molecular weight and has a melting transition onset point at about 30° C. and end point at about 50° C., as determined by DSC. This polymer is obtained from ICI Americas Inc.

Particularly preferred nonionic polymeric soil release agents are disclosed in allowed U.S. patent application Ser. No. 801,020, of Eugene P. Gosselink, filed Nov. 22, 1985, incorporated herein by reference, having the empirical formula:

$$X_2\text{-}(O-C_2H_4)_{n-2n}\text{-}(OR^5)_{m-2m}\text{-}(A-R^1-A-R^2)_u\text{-}(A-R^3-A-R^2)_v\text{-}(A-R^4-A)\text{-}$$

and is believed to have the formula:

$$X\text{-}(OCH_2CH_2)_n(OR^5)_m\text{-}\text{-}(A-R^1-A-R^2)_u(A-R^3-A-R^2)_v\text{-}A-R^4-A\text{-}(R^5O)_m(CH_2CH_2O)_n\text{-}X$$

wherein the A moieties are essentially $$-\overset{O}{\overset{\|}{C}}O- \quad \text{or} \quad -\overset{O}{\overset{\|}{C}}O-$$

moieties; the $R^1$ moieties are essentially 1,4-phenylene moieties; and $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarbylene moieties having at least one $-SO_3M$, $-COOM$, $-O[(R^5O)_m(CH_2CH_2O)_n]-X$ or $[-A-(R^2-A-R^4-A)]_w[(R^5O)_m(CH_2CH_2O)_n]-X$ substituent or at least one moiety $-[A-(R^2-A-R^4-A)]_wR^2-A-$ crosslinked to another $R^3$ moiety; the $R^4$ moieties are $R^1$ or $R^3$ moieties, or a mixture thereof; each $R^5$ is $C_3$–$C_4$ alkylene, or the moiety $-R^2-A-R^6-$, wherein $R^6$ is a $C_1$—$C_{12}$ alkylene, alkenylene, arylene or alkarylene moiety; each M is H or a water-soluble cation; each X is H, $C_1$–$C_4$ alkyl or $$-\overset{O}{\overset{\|}{C}}R^7,$$

wherein $R^7$ is $C_1$–$C_4$ alkyl; m and n are numbers such that the moiety $-(CH_2CH_2O)-$ comprises at least about 50% by weight of the moiety $-[(R^5O)_m(CH_2CH_2O)_n]-$, provided that when $R^5$ is the moiety $-R^2-A-R^6-$, m is 1; each n is at least about 5; u and v are numbers such that the sum of u+v is from about 3 to about 25; w is 0 or at least 1; and when w is at least 1, u, v and w are numbers such that the sum of u+v+w is from about 3 to about 25.

This latter polymer is particularly preferred when the formula is:

$$X-(OCH_2CH_2)_n-\left(OC-\overset{O}{\overset{\|}{C}}-R^1-CO-\overset{O}{\overset{\|}{C}}-R^2\right)_u-OC-\overset{O}{\overset{\|}{C}}-R^1-CO-\overset{O}{\overset{\|}{C}}-(CH_2CH_2O)_n-X$$

wherein each $R^1$ is a 1,4-phenylene moiety; the $R^2$ consist essentially of ethylene moieties, 1,2-propylene moieties or a mixture thereof; each X is ethyl or preferably methyl; each n is from about 12 to about 43; u is from about 1 to about 10.

A preferred polymeric soil release agent is POET (polyoxyethylene terephthalate), a compound with the general empirical and, it is believed, specific formulae described hereinabove. It is synthesized from the following reactants:

1. Poly(ethylene glycol)methyl ester, M.W. 750, Aldrich Chemical Co., 1000 g (1.33 moles)
2. Dimethyl terephthalate, M.W. 195, Aldrich Chemical Co., 359.9 g (1.85 moles)
3. Ethylene glycol, M.W. 62, Aldrich Chemical Co., 146.4 g (2.36 moles)
4. Calcium acetate, MCB, 7.9g (catalyst)
5. Antimony trioxide, Fisher Scientific, 7.9g (catalyst)
6. Butylated hydroxytoluene, Aldrich Chemical Co., 3.6g (antioxidant).

The reaction is carried out by adding all of the above to a 2 liter round bottom flask equipped with mechanical agitation. A 14 inch unpacked column is also fitted to the flask for methanol distillation. The system is placed under a nitrogen atmosphere and the temperature is gradually raised to 200° C. once the reaction mixture melts. Reaction conditions of 200° C., atmospheric pressure, and constant mechanical agitation are maintained for 20 hours. To further drive the ester interchange reaction to completion, the reaction mixture is cooled to 130° C., the methanol receiving flask is emptied, and vacuum is applied while concurrently introducing nitrogen sparge below the level of the liquid reaction mixture. An absolute pressure of 25 mm Hg is obtained. Over a period of 2 hours the temperature is gradually raised to 190° C., distilling more methanol and ethylene glycol. To complete the reaction, the temperature is raised to 200° C. and the pressure is reduced to 20 mm Hg. The nitrogen flow into the reaction mixture is discontinued. After 3.5 hours, the reaction is essentially complete as indicated by reverse phase HPLC analysis. (Using a column packed with hexyl capped silica particles and an acetonitrile/water gradient elution). This analysis shows that a sizable part of the polymer contains 4 or more terephthalate units per molecule. The general formula for the resulting compound is believed to be:

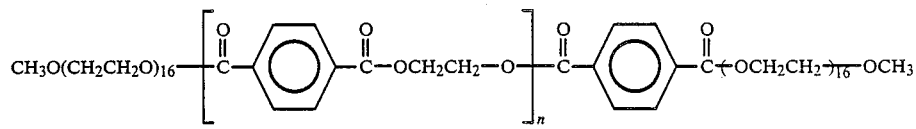

wherein n=1.75 on average.

The resulting polymer was submitted to a three-solvent (short chain alcohols) extraction (IPA, EtOH, MeOH) and the EtOH, MeOH soluble fractions are combined in the ratio of 67:33.

This extraction procedure results in a polymer sample containing predominantly 3 to 5 terephthalate units per molecule as shown by HPLC analysis.

Another preferred polymer has the following average structure:

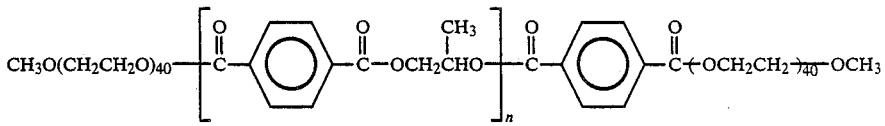

wherein n is about 4 to 6 on average.

In general, the soil release polymer is preferably a solid at room temperature, has a softening phase transition temperature at or above 30° C. and becomes a flowable liquid below 100° C., more preferably below 90° C.

Fabric Softening Agent

The term "fabric softening agent" as used herein includes cationic and nonionic fabric softeners used alone and also in combination with each other. A preferred fabric softening agent of the present invention is a mixture of cationic and nonionic fabric softeners.

Examples of fabric softening agents are the compositions described in U.S. Pat. Nos. 4,103,047, Zaki et al., issued July 25, 1978; 4,237,155, Kardouche, issued Dec. 2, 1980; 3,686,025, Morton, issued Aug. 22, 1972; 3,849,435, Diery et al., issued Nov. 19, 1974; and U.S. Pat. No. 4,037,996, Bedenk, issued Feb. 14, 1978; said patents are hereby incorporated herein by reference. Particularly preferred cationic fabric softeners of this type include quaternary ammonium salts such as dialkyl dimethylammonium chlorides, methylsulfates and ethylsulfates wherein the alkyl groups can be the same or different and contain from about 14 to about 22 carbon atoms. Examples of such preferred materials include ditallowalkyldimethylammonium methylsulfate, distearyldimethylammonium methylsulfate, dipalmityldimethylammonium methylsulfate and dibehenyldimethylammonium methylsulfate. Also particularly preferred is the carboxylic acid salt of a tertiary alkylamine disclosed in said Kardouche patent. Examples include stearyldimethylammonium stearate, distearylmethylammonium myristate, stearyldimethylammonium palmitate, distearylmethylammonium palmitate, and distearylmethylammonium laurate. These carboxylic salts can be made in situ by mixing the corresponding amine and carboxylic acid in the molten fabric conditioning composition.

Another preferred type of fabric softener is described in detail in U.S. Pat. No. 4,661,269 of Toan Trinh, Errol H. Wahl, Donald M. Swartley and Ronald L. Hemingway, issued Apr. 28, 1987, and in the copending U.S. patent application of Allen D. Clauss, Gayle E. Culver, David M. Piatt and Thomas J. Wierenga, Ser. No. 058,449, filed June 5, 1987, said patent and said application being incorporated herein by reference.

Examples of nonionic fabric softeners are the sorbitan esters, described herein and $C_{12}$–$C_{26}$ fatty alcohols and fatty amines as described herein.

A preferred article of the present invention includes a fabric conditioning composition which comprises 10% to 70% of polymeric soil release agent, and 30% to 90% of a fabric softening agent, said fabric softening agent is selected from cationic and nonionic fabric softeners, and mixtures thereof. Preferably, said fabric softening agent comprises a mixture of about 5% to about 80% of a cationic fabric softener and about 10% of a nonionic fabric softener by weight of said fabric conditioning composition. The selection of the components is such that the resulting fabric conditioning composition has a melting point above about 38° C. and being flowable at dryer operating temperatures.

A preferred fabric softening agent comprises a mixture of $C_{10}$–$C_{26}$ alkyl sorbitan esters and mixtures thereof, a quaternary ammonium salt and an tertiary alkylamine. The quaternary ammonium salt is preferably present at a level of from about 5% to about 25%, more preferably from about 7% to about 20% of the fabric conditioning composition. The sorbitan ester is preferably present at a level of from about 10% to about 50%, more preferably from about 20% to about 40%, by weight of the total fabric conditioning composition. The tertiary alkylamine is present at a level of from about 5% to about 25%, more preferably from 7% to about 20% by weight of the fabric conditioning composition. The preferred sorbitan ester comprises a member selected from the group consisting of $C_{10}$–$C_{26}$ alkyl sorbitan monoesters and $C_{10}$–$C_{26}$ alkyl sorbitan diesters, and ethoxylates of said esters wherein one or more of the unesterified hydroxyl groups in said esters contain from 1 to about 6 oxyethylene units, and mixtures thereof. The quaternary ammonium salt is preferably in the methylsulfate form. The preferred tertiary alkylamine is selected from the group consisting of alkyldimethylamine and dialkylmethylamine and mixtures thereof, wherein the alkyl groups can be the same of different and contain from about 14 to about 22 carbon atoms.

Another preferred fabric softening agent comprises a carboxylic acid salt of a tertiary alkylamine, in combination with a fatty alcohol and a quaternary ammonium salt. The carboxylic acid salt of a tertiary amine is used in the fabric conditioning composition preferably at a level of from about 5% to about 50%, and more preferably, from about 15% to about 35%, by weight of the fabric conditioning composition. The quaternary ammonium salt is used preferably at a level of from about 5% to about 25%, and more preferably, from about 7% to about 20%, by weight of the total fabric conditioning composition. The fatty alcohol can be used preferably at a level of from about 10% to about 25%, and more preferably from about 10% to about 20%, by weight of the fabric conditioning composition. The preferred quaternary ammonium salt is selected from the group consisting of dialkyl dimethylammonium salt wherein the alkyl groups can be the same or different and contain from about 14 to about 22 carbon atoms and wherein the counteranion is selected from the group consisting of chloride, methylsulfate and ethylsulfate, preferably methylsulfate. The preferred carboxylic acid salt of a tertiary alkylamine is selected from the group consisting of fatty acid salts of alkyldimethylamines wherein the alkyl group contains from about 14 to about 22 carbon atoms. The preferred fatty alcohol contains from about 14 to about 22 carbon atoms.

Protecting Agent

The protecting agents are materials that will distribute during the drying cycle, but which will preferentially solidify (crystallize) before any other material that is present which tends to adversely affect dryer surfaces, e.g., softening, staining and/or corroding. This protecting agent permits dryer manufacturers to have a larger selection of finishes.

The protecting agent is very desirable when the softening agent or the soil release agent contains polyethylene oxide linkages and especially when one, or both, are nonionic materials. The protecting agent is especially desirable when used with, e.g., intimately mixed with, or applied separately with, the soil release agents of U.S. Pat. application Ser. No. 801,020, supra. The protecting agent provides several benefits. Where one, or more, of the conditioning agents will interact with the dryer surface to either soften or color it (e.g., enamel or paint surfaces), corrode it, etc., the protecting agent will minimize the adverse effect. It is believed that the protecting agents herein operate by forming a thin solid film on the surface of the dryer. Accordingly, the protecting agent should be one that mobilizes and readily spreads on the surface into a thin film, and should be in a form that permits it to solidify at the dryer surface before any other ingredient that is harmful to the dryer surface. The protecting agent should not be combined with any ingredient that will keep it a liquid under all dryer conditions. The protecting agent, or agents, should readily separate from the other ingredients and especially from those ingredients that adversely affect the dryer surface. Suitable protecting agents are:

(a) Diesters of ethylene glycol, propylene glycol, or diethylene glycol with fatty acids containing from about 14 to about 22, preferably from about 16 to about 20, carbon atoms with the sum of the carbon atoms in the acyl groups being from about 30 to about 48, preferably from about 34 to about 40, and the melting point being from about 50° C. to about 95° C., preferably from about 60° C. to about 85° C. Specific materials include ethylene glycol distearate, ethylene glycol ditallowate, ethylene glycol dibehenate and diethylene glycol distearate.

(b) Crystalline hydrocarbons having melting points from about 50° C. to about 95° C., preferably from about 60° C. to about 85° C. Suitable materials include n-alkanes containing from about 24 to about 40, preferably from about 26 to about 36 carbon atoms, and microcrystalline waxes having melting points from about 50° C. to about 95° C., preferably from about 60° C. to about 85° C.

(c) Di (long chain alkyl) ethers, esters, ketones and amides having the formula R—A—R wherein each A is $$-O-,\ -COO-,\ -\overset{\overset{\displaystyle O}{\|}}{C}-,\ \text{or}\ -CONH-,$$

and each R contains from about 14 to about 24, preferably from about 16 to about 24 carbon atoms and the sum of the carbon atoms is from about 28 to about 45, preferably from about 34 to about 45, and the melting point being from about 50° C. to about 95° C., preferably from about 60° C. to about 85° C. Suitable materials are distearyl, ditallowoyl- and dibehenyl ethers, stearyl stearate, palmityl stearate, tallowyl tallowate, stearyl behenate, behenyl behenate and stearyl stearamide.

The protecting agents can be attached to substrate dispensing means separately or after admixture with any material that will allow separation and crystallization in the dryer.

Optional Ingredients

Well known optional components included in the fabric conditioning composition which are useful in the present invention are narrated in U.S. Pat. No. 4,103,047, Zaki et al., issued July 25, 1978, for "Fabric Treatment Compositions," incorporated herein by reference.

Dispensing Means

The fabric conditioning compositions can be employed by simply adding a measured amount into the dryer, e.g., as liquid dispersion. However, in a preferred embodiment, the fabric conditioners are provided as an article of manufacture in combination with a dispening means such as a flexible substrate which effectively releases the composition in an automatic clothes dryer. Such dispensing means can be designed for single usage or for multiple uses.

One such article comprises a sponge material releasably enclosing enough fabric conditioning composition to effectively impart fabric soil release and softness benefits during several cycles of clothes. This multi-use article can be made by filling a hollow sponge with about 20 grams of the fabric conditioning composition.

Other devices and articles suitable for dispensing the fabric conditioning composition into automatic dryers include those described in U.S. Pat. Nos. 4,103,047, Zaki et al., issued July 25, 1978; 3,736,668, Dillarstone, issued June 5, 1973; 3,701,202, Compa et al., issued Oct. 31, 1972; 3,634,947, Furgal, issued Jan. 18, 1972; 3,633,538, Hoeflin, issued Jan. 11, 1972; and 3,435,537, Rumsey, issued Apr. 1, 1969. All of these patents are incorporated herein by reference.

A highly preferred article herein comprises the fabric conditioning composition releasably affixed to a flexible substrate in a sheet configuration. Highly preferred paper, woven or nonwoven "absorbent" substrates useful herein are fully disclosed in Morton, U.S. Pat. No. 3,686,025, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Determination of absorbent capacity values is made by using the capacity testing procedures described in U.S. Federal Specifications UU-T-595b, modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4, commercially available household one-ply toweling paper has a value of 5 to 6; and commercially available two-ply household toweling paper has a value of 7 to about 9.5.

Using a substrate with an absorbent capacity of less than 4 tends to cause too rapid release of the fabric conditioning composition from the substrate resulting in several disadvantages, one of which is uneven conditioning of the fabrics. Using a substrate with an absorbent capacity over 12 is undesirable, inasmuch as too little of the fabric conditioning composition is released to condition the fabrics in optimal fashion during a normal drying cycle.

Such a substrate comprises a nonwoven cloth having an absorbent capacity of preferably from about 5 to 7 and wherein the weight ratio of fabric conditioning composition to substrate on a dry weight basis ranges from about 5:1 to 1:1.

Nonwoven cloth substrate preferably comprises cellulosic fibers having a length of from 3/16 inch to 2 inches and a denier of from 1.5 to 5 and the substrate is adhesively bonded together with a binder resin.

The flexible substrate preferably has openings sufficient in size and number to reduce restriction by said article of the flow of air through an automatic laundry dryer. The better openings comprise a plurality of rectilinear slits extended along one dimension of the substrate.

Usage

The method aspect of this invention for imparting the above-described fabric conditioning composition to provide soil release, softening and antistatic effects to fabrics in an automatic laundry dryer comprises: commingling pieces of damp fabrics by tumbling said fabrics under heat in an automatic clothes dryer with an effective amount of the fabric conditioning composition, said composition having a melting point greater than about 38° C. and being flowable at dryer operating temperature, said composition comprising from about 1% to 70% of a polymeric soil release agent, and 30% to 99% of a fabric softening agent selected from the above-defined cationic and nonionic fabric softeners and mixtures thereof. Under such usage conditions, the protecting agent provides the desired protective effect to the dryer surface.

The method herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. The fabric conditioning composition can simply be spread uniformly over all fabric surfaces, for example, by sprinkling the composition onto the fabrics from a shaker device. Alternatively, the composition can be sprayed or otherwise coated on the dryer drum, itself. The dryer is then operated in standard fashion to dry the fabrics, usually at a temperature from about 50° C. to about 80° C. for a period from about 10 minutes to about 60 minutes, depending on the fabric load and type. On removal from the dryer, the dried fabrics have been treated for soil release benefits and are softened. Moreover, the fabrics instantaneously sorb a minute quantity of water which increases the electrical conductivity of the fabric surfaces, thereby quickly and effectively dissipating static charge. The drum is coated at least in part with said protecting agent.

In a preferred mode, the present process is carried out by fashioning an article comprising the substrate-like dispensing means of the type hereinabove described in releasable combination with a fabric conditioning composition. This article is simply added to a clothes dryer together with the damp fabrics to be treated. The heat and tumbling action of the revolving dryer drum evenly distributes the protecting agent over the dryer surface.

The following are nonlimiting examples of the instant articles and methods.

PREPARATION OF THE EXAMPLES

Example 1

A dryer-added fabric conditioning article comprising a rayon nonwoven fabric substrate (having a weight of 1.22 gm per 99 sq. in.) and a fabric conditioning composition is prepared in the following manner.

A fabric softening agent premixture is initially prepared by admixing 110 parts octadecyldimethylamine with 84 part $C_{18}$ fatty acid and 88.5 parts $C_{12}$ fatty acid at 70° C. The softening agent mixture is completed by then adding and mixing in 117 parts sorbitan monostearate and 117 parts ditallowdimethylammonium methylsulfate at 70° C. To the softening agent mixture, 392.3 parts of premelted and premixed polyethylene terephthalate-polyoxyethylene terephthalate copolymeric soil release agent (335.5 parts) and ethyleneglycol distearate (56.8 parts) at 85° C. is added slowly and with high shearing to finely disperse the polymer-EGDS blend. After the addition is completed and a sufficient period of mixing time has elapsed, 64 parts of Bentolite L particulate clay is added slowly while maintaining the high-shear mixing action. An amount of 27.2 parts of perfume is added to complete the preparation of the fabric conditioning composition.

The flexible substrate, comprised of 70% 3-denier, 1-9/16" long rayon fibers and 30% polyvinyl acetate binder, is impregnated by coating one side of a continu-

TABLE 1

| | Examples: | | | | | | | | | | | |
|---|---|---|---|---|---|---|---|---|---|---|---|---|
| Ingredients | 1 Wt. % | 2 Wt. % | 3 Wt. % | 4 Wt. % | 5 Wt. % | 6 Wt. % | 7 Wt. % | 8 Wt. % | 9 Wt. % | 10 Wt. % | 11 Wt. % | 12 Wt. % |
| Soil Release Agents: | | | | | | | | | | | | |
| Milease TL[a] | 33.55 | 20.30 | 33.55 | 33.55 | — | 33.55 | — | — | 22.00 | — | — | 33.55 |
| Zelcon PGA[b] | — | — | — | — | 40.00 | — | — | — | — | — | — | — |
| POPT[c] | — | — | — | — | — | — | 33.55 | — | — | 22.00 | 22.00 | — |
| POET[d] | — | — | — | — | — | — | — | 41.00 | — | — | — | — |
| Fabric Softening Agents: | | | | | | | | | | | | |
| DTDMAMS[e] | 11.70 | 15.00 | 11.97 | 11.81 | 20.00 | 11.70 | 11.10 | — | 15.00 | 15.00 | 15.00 | 11.97 |
| Octadecyldimethylamine | 11.00 | 14.07 | 14.82 | 14.62 | — | 11.00 | 13.90 | — | 14.07 | 14.07 | 14.07 | 14.83 |
| $C_{18}$ Fatty Acid | 8.40 | 10.75 | — | — | — | 8.40 | 12.80 | — | 10.75 | 10.75 | 10.75 | — |
| $C_{12}$ Fatty Acid | 8.85 | 11.38 | — | — | — | 8.85 | — | — | 11.38 | 11.38 | 11.38 | — |
| $C_{16}$-$C_{18}$ Fatty Acid | — | — | 13.68 | 13.49 | — | — | — | — | — | — | — | 13.68 |
| $C_{16}$-$C_{18}$ Fatty Alcohol | — | — | 11.97 | — | — | — | 11.10 | — | — | — | — | 11.97 |
| Sorbitan Monostearate | 11.70 | 15.00 | — | 11.81 | 30.00 | 30.00 | — | 41.30 | 15.00 | 15.00 | 15.00 | — |
| Protecting Agents: | | | | | | | | | | | | |
| EGDS[f] | 5.68 | 5.00 | 8.00 | 6.00 | 6.00 | — | — | — | — | — | — | — |
| DEGDS[g] | — | — | — | — | — | 5.68 | — | — | — | — | — | — |
| Octacosane | — | — | — | — | — | — | 8.00 | — | — | — | — | — |
| Dotriacontane | — | — | — | — | — | — | — | 10.00 | — | — | — | — |
| Hexatriacontane | — | — | — | — | — | — | — | — | 6.00 | — | — | — |
| Distearyl Ether | — | — | — | — | — | — | — | — | — | 6.00 | — | — |
| Stearyl Stearate | — | — | — | — | — | — | — | — | — | — | 6.00 | — |
| Stearyl Stearamide | — | — | — | — | — | — | — | — | — | — | — | 6.00 |
| Viscosity Modifier: | | | | | | | | | | | | |
| Calcium Bentonite Clay[h] | 6.40 | 6.00 | 6.00 | 6.00 | 4.00 | 6.40 | 7.20 | 6.20 | 5.80 | 5.80 | 5.80 | 6.00 |
| Perfume | 2.72 | 2.50 | — | 2.72 | — | 2.72 | 2.35 | 1.50 | — | — | — | 2.00 |
| Total | 100.0% | 100.0% | 100.0% | 100.0% | 100.0% | 100.0% | 100.0% | 100.0% | 100.0% | 100.0% | 100.0% | 100.0% |
| Article Composition: | | | | | | | | | | | | |
| Substrate weight, grams/sq. yd. | 16 | 18 | 18 | 18 | 18 | 16 | 18 | 18 | | 16 | 16 | 16 |
| Coating weight, grams/9" × 11" sheet | 3.0 | 2.8 | 3.0 | 3.6 | 3.0 | 3.0 | 3.0 | 3.6 | | 2.8 | 2.8 | 3.0 |

[a]Milease TL is polyethylene terephthalate-polyoxyethylene terephthalate copolymer obtained from ICI Americas. It is described hereinabove in the section entitled "Polymeric Soil Release Agent."
[b]Zelcon PGA is polyethylene terephthalate-polyoxyethylene terephthalate copolymer obtained from DuPont. It is described hereinabove in the section entitled, "Polymeric Soil Release Agent."
[c]POPT is (polyoxypropylene terephthalate) is a copolymer with the general formula described hereinabove in the section entitled "Polymeric Soil Release Agent."
[d]POET (polyoxyethylene terephthalate) is a copolymer with the general formula described hereinabove in the section entitled "Polymeric Soil Release Agent."
[e]DTDMAMS is ditallowdimethylammonium methylsulfate.
[f]EGDS is ethyleneglycol distearate.
[g]DEGDS is diethyleneglycol distearate.
[h]Bentolite L sold by Southern Clay Products.

ous length of the substrate and contacting it with a rotating cylindrical member which serves to press the liquified mixture into the interstices of the substrate. The substrate is passed over several chilled tension rolls which help solidify the conditioning mixture. The substrate sheet is 9" wide and is perforated in lines at 11" intervals to provide detachable sheets. Each sheet is cut with a set of knives to provide three evenly spaced parallel slits averaging about 4" in length.

Example 2

A dryer-added fabric conditioning article comprising a rayon nonwoven fabric substrate (having a weight of 1.38 gm per 99 sq. in.) and a fabric conditioning composition is prepared in the following manner.

The soil release blend is initially prepared by admixing 253 parts of premelted polyethylene terephthalate-polyoxyethylene terephthalate copolymeric soil release agent (203 parts) and ethyleneglycol distearate (50 parts) at 85° C. To the polymer-EGDS mixture, 362 parts of premelted and preblended octadecyldimethylamine (140.7 parts) with $C_{18}$ fatty acid (107.5 parts) and $C_{12}$ fatty acid (113.8 parts) at 70° C. are added while maintaining the high-shear mixing action. After the addition is completed, 300 parts of premelted and preblended sorbitan monostearate (150 parts) and ditallowdimethylammonium methylsulfate (150 parts) at 70° C. are added while maintaining the high-shear mixing action. After the second softening agent blend addition is completed and a sufficient period of mixing time has elapsed, 60 parts of Bentolite L particulate clay is added slowly while maintaining the high-shear mixing action. An amount of 25 parts of perfume is added to complete the preparation of the fabric conditioning composition.

Impregnation of the flexible substrate with the fabric conditioning composition is carried out in the same manner as in Example 1.

Example 3

A dryer-added fabric conditioning article comprising a rayon nonwoven fabric substrate (having a weight of 1.38 gm per 99 sq. in.) and a fabric conditioning composition is prepared in the following manner.

A fabric softening agent premixture is initially prepared by admixing 148.2 parts of octadecyldimethylamine with 136.8 parts of $C_{16}$–$C_{18}$ fatty acid at 70° C. The softening agent mixture is completed by then adding and mixing in 119.7 parts of $C_{16}$–$C_{18}$ fatty alcohol and 119.7 parts of ditallowdimethylammonium methylsulfate at 70° C. To the softening agent mixture 335.5 parts of premelted polyethylene terephthalate-polyoxyethylene terephthalate copolymeric soil release agent at 85° C. is added slowly and with high shearing to finely disperse the polymer. After the addition is completed and a sufficient period of mixing time has elapsed, 60 parts of Bentolite L particulate clay is added slowly while maintaining the high-shear mixing action. Eighty parts of EGDS at 75° C. is then slowly added while maintaining the high-shear mixing action.

Impregnation of the flexible substrate with the fabric conditioning composition is carried out in the same manner as in Example 1.

Example 4–12

Dryer-added fabric conditioning articles are prepared in the same manner as in Example 1, in that the soil release agent-protecting agent blends are added to the fabric softening agent blends.

What is claimed is:

1. An article of manufacture adapted to provide fabric soil release benefits and soften fabrics in an automatic laundry dryer comprising:

(a) fabric conditioning agent selected from the group consisting of polymeric soil release agent, fabric softening agent, and mixtures thereof, that tend to damage one or more dryer surfaces;

(b) protecting agent to provide protection for the surface of said automatic laundry dryer having the formula RZR, wherein each R is a hydrocarbon group containing from 14 to 24 carbon atoms preferably alkyl; each Z is selected from the group consisting of an ester group, an amide group, a ketone group, an ether group, $$-\overset{O}{\overset{\|}{C}}-O(C_2H_4O)_nC-$$

wherein each n is 0 or 1, and mixtures thereof, and wherein said protecting agent can be mobilized under said dryer's conditions, but will crystallize before said fabric conditioning agents; and (c) a dispensing means which provides for release of an effective amount of said composition to fabrics in the dryer at automatic dryer operating temperatures.

2. The article of claim 1 wherein said protecting agent is selected from the group consisting of diesters of ethyleneglycol, propyleneglycol or diethyleneglycol with fatty acids which contain a total of from about 30 to about 48 carbon atoms.

3. The article of claim 2 wherein said protecting agent is ethyleneglycol distearate.

4. The article of claim 1 wherein said protecting agent is selected from the group consisting of di long chain alkyl ethers, esters, ketones and amides having the formula R—A—R wherein each A is selected from the group consisting of $$-O-,\ -COO-,\ -\overset{O}{\overset{\|}{C}}-,\ \text{and}\ -CONH-,$$

and each R contains from about 14 to about 24 carbon atoms.

5. The article of claim 1 wherein said fabric conditioning agent comprises a nonionic polymeric soil release agent having the empirical formula:

$$X_2\left(O-C_2H_4\right)_{n-2n}\left(OR^5\right)_{m-2m}\left(A-R^1-A-R^2\right)_u\left(A-R^3-A-R^2\right)_v\left(A-R^4-A\right)$$

wherein the A moieties are essentially $$-\overset{O}{\overset{\|}{O}}C-\quad\text{or}\quad-\overset{O}{\overset{\|}{C}}O-$$

moieties; the $R^1$ moieties are essentially 1,4-phenylene moieties; and $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarbylene moieties having at least one $—SO_3M$, —COOM, $—O[(R^5O)_m(CH_2CH_2O)_n]X$ or $—A—(R^2—A—R^4—A)]_w[(R^5O)_m(CH_2CH_2O)_n]X$ substituent or at least one moiety $[A—(R^2—A—R^4—A)]_wR^2—A—$crosslinked to another $R^3$ moiety; the $R^4$ moieties are $R^1$ or $R^3$ moieties, or a mixture thereof; each $R^5$ is $C_3$—$C_4$ alkylene, or the moiety $—R^2—A—R^6—$, wherein $R^6$ is a $C_1$–$C_{12}$ alkylene, alkenylene, arylene or alkarylene moiety; each M is H or a water-soluble cation; each X is H, $C_1$–$C_4$ alkyl or $$—\overset{O}{\overset{\|}{C}}R^7,$$

wherein $R^7$ is $C_1$–$C_4$ alkyl; m and n are numbers such that the moiety $—(CH_2CH_2O)$ —comprises at least about 50% by weight of the moiety $[(R^5O)_m(CH_2CH_2O)_n]$, provided that when $R^5$ is the moiety $—R^2—A—R^6—$,m is 1; each n at least about 5; u and v are numbers such that the sum of u+v is from about 3 to about 25; w is 0 or at least 1; and when w is at least 1, u, v and w are numbers such that the sum of u+v+w is from about 3 to about 25.

6. The article of claim 5 wherein said protecting agent is selected from the group consisting of diesters of ethyleneglycol, propyleneglycol or diethyleneglycol with fatty acids which contain a total of from about 30 to about 48 carbon atoms.

7. The article of claim 6 wherein said protecting agent is ethyleneglycol distearate.

8. The article of claim 1 wherein said polymeric soil release agent is a polyester copolymer with repeat units of ethylene terephthalate units containing 10–50% by weight of ethylene terephthalate units together with 90–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1.

9. An article according to claim 8 wherein the polyoxyethylene terephthalate units of said polymeric soil release agent are derived from a polyethylene glycol of average molecular weight of from about 1000 to about 4000.

10. An article according to claim 8 wherein said said polyethylene glycol has an average molecular weight of about 1500 and polymeric soil release agent has a softening phase transition temperature of at least about 30° C., and becomes a flowable liquid below 100° C.

11. The article of claim 8 wherein said protecting agent is selected from the group consisting of diesters of ethyleneglycol, propyleneglycol or diethyleneglycol with fatty acids which contain a total of from about 30 to about 48 carbon atoms.

12. The article of claim 11 wherein said protecting agent is ethyleneglycol distearate.

13. The article of claim 8 wherein said protecting agent is selected from the group consisting of di long chain alkyl ethers, esters, ketones and amides having the formula R—A—R wherein each A is selected from the group consisting of $$—O—,\ —COO—,\ —\overset{O}{\overset{\|}{C}}—,\ \text{and}\ —CONH—,$$

and each R contains from about 14 to about 24 carbon atoms.

14. The process of making the article of claim 8 wherein said protecting agent is first intimately mixed with said nonionic polymeric soil release agent.

* * * * *

UNITED STATES PATENT AND TRADEMARK OFFICE

CERTIFICATE OF CORRECTION

PATENT NO. : 4,834,895

DATED : May 30, 1989

INVENTOR(S) : THOMAS E. COOK et al.

It is certified that error appears in the above-identified patent and that said Letters Patent is hereby corrected as shown below:

Col. 1, line 57, "2" should be -- Z --

Col. 7, line 26, after "10%" insert -- to about 85% --.

Col. 15, line 3,

" $-A-(R^2-A-R^4-A)\cancel{]_w[(}R^5O)_m(CH_2CH_2O)_n\cancel{]}X$ " should be

-- $-A\cancel{[}(R^2-A-R^4-A)\cancel{]_w[(}R^5O)_m(CH_2CH_2O)_n\cancel{]}X$ --.

Col. 15, lines 4 and 5, " $\cancel{[}A-(R^2-A-R^4-A)\cancel{]}_wR^2-A-$ "

should be -- $-A\cancel{[}(R^2-A-R^4-A)\cancel{]}_wR^2-A-$ --.

Signed and Sealed this

Eighteenth Day of September, 1990

*Attest:*

*Attesting Officer*

HARRY F. MANBECK, JR.

*Commissioner of Patents and Trademarks*